US005219192A

United States Patent [19]

Berger

[11] Patent Number: 5,219,192

[45] Date of Patent: Jun. 15, 1993

[54] REMOVABLE SPINDLE

[75] Inventor: Simon Berger, Lido Beach, N.Y.

[73] Assignee: Securitech Group, Inc., Maspeth, N.Y.

[21] Appl. No.: 913,305

[22] Filed: Jul. 14, 1992

[51] Int. Cl.[5] ..... E05C 1/16

[52] U.S. Cl. ..... 292/173; 292/358; 292/DIG. 64; 292/347

[58] Field of Search ..... 292/173, 350, 356, 347, 292/DIG. 64, 358

[56] References Cited

U.S. PATENT DOCUMENTS

| | | | |
|---|---|---|---|
| 1,663,417 | 3/1928 | Schunck et al. | 292/358 X |
| 1,847,797 | 3/1932 | Vernooy | 293/358 X |
| 2,442,763 | 6/1948 | Falk | 70/211 |
| 4,471,984 | 9/1984 | Bellantuono | 292/358 X |
| 4,667,994 | 5/1987 | Foshee | 292/358 |
| 4,746,155 | 5/1988 | Hart | 292/358 X |
| 4,899,561 | 2/1990 | Myers | 292/358 X |

*Primary Examiner*—Richard E. Moore

*Attorney, Agent, or Firm*—Abelman Frayne & Schwab

[57] ABSTRACT

A door locking assembly which facilitates removal and replacement of a damaged lockset without the need to remove the cylinder, levers or knobs, or the escutcheon plates, which includes a lockset mountable within a door, said lockset including a latch for locking the door, a spindle engageable with the lockset, said lockset including a bushing defining a spindle aperture for accommodating a first end of the spindle, said spindle being adapted to rotatably displace the bushing for actuating the latch, a handle for securing a second end of the spindle, said handle means defining a socket for withdrawing the spindle to remove the lockset from within the door.

20 Claims, 3 Drawing Sheets

REMOVABLE SPINDLE

FIELD OF THE INVENTION

This invention relates to an improved door locking assembly and, more particularly, relates to a means for quickly and readily gaining access to a damaged or vandalized latch lock or deadlatch and replacing same without the need to remove and replace the cylinder, the knobs or levers, and the decorative trim, such as escutcheon plates. A tamperproof cap for the door locking assembly is also provided.

BACKGROUND OF THE INVENTION

In large apartment houses in urban areas, where there is considerable traffic entering and exiting the building, various locking devices have been employed on the front entrance doors in order to secure the premises and to deter unauthorized entry. In such buildings, however, where the front entrance is not manned or patrolled, damage to the mechanical or electromechanical locking systems employed is an all too frequent occurrence. As a consequence, the repair of the locking mechanism, which most often means repair of a mortise style latch lock, or a deadlatch, requires the services of a professional locksmith, which is both time-consuming and expensive, and in some instances where the lock is electro-mechanical in nature, it also requires the services of an electrician. In mechanical locks, in order to replace the vandalized lock, the locksmith must remove the cylinder, the lever or knobs and the decorative trim in order to remove the damaged lock and replace it with a new one.

Accordingly, it is an object of the present invention to provide a means for quickly and easily gaining access to a damaged mortise style latch lock or deadlatch and to remove and replace it with a new lock without the need of removing the cylinder, the lever or knobs and the escutcheon plate.

It is another object of the present invention to provide a capping means on a handle of a door locking assembly to prevent a latch lock or a deadlatch from being damaged.

It is still another object of the present invention to provide a hub member of a doorlocking assembly with means to limit the degree of rotation of the door's handle.

SUMMARY OF THE INVENTION

By means of the present invention, a door locking assembly for a mortise lock set, whether a latch lock or a deadlatch, is provided with a spindle, which is readily removable from the locking assembly when the lock is damaged and in need of repair without the need to disturb or remove the escutcheon plates, the levers or knobs, or the cylinder.

The door locking assembly comprises a lockset mountable within a door, said lockset including latch means for locking the door, spindle means engageable with the lockset, said lockset including a bushing defining a spindle aperture for accommodating a first end of the spindle means, said spindle means being adapted to rotatably displace the bushing for actuating the latch means, handle means for receiving a second end of the spindle means, said handle means defining a socket for withdrawing the spindle means to remove the lockset from the edge of the door without removing the escutcheons.

Once the spindle is removed, the damaged lock is readily accessible and can be removed and replaced by a new lock. By means of the foregoing, the replacement of a lock can be accomplished by building personnel without the need to call upon the services of a professional locksmith. Furthermore, the downtime normally associated with a broken lock and the time needed for its repair can be considerably foreshortened, without comprising the safety and security of the building tenants.

Additionally, the present invention contemplates the use of a novel and securable end cap which rotates freely in conjunction with the handle and whose novel tamperproof construction deters damage due to vandalism.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF THE INVENTION

Figure 1:
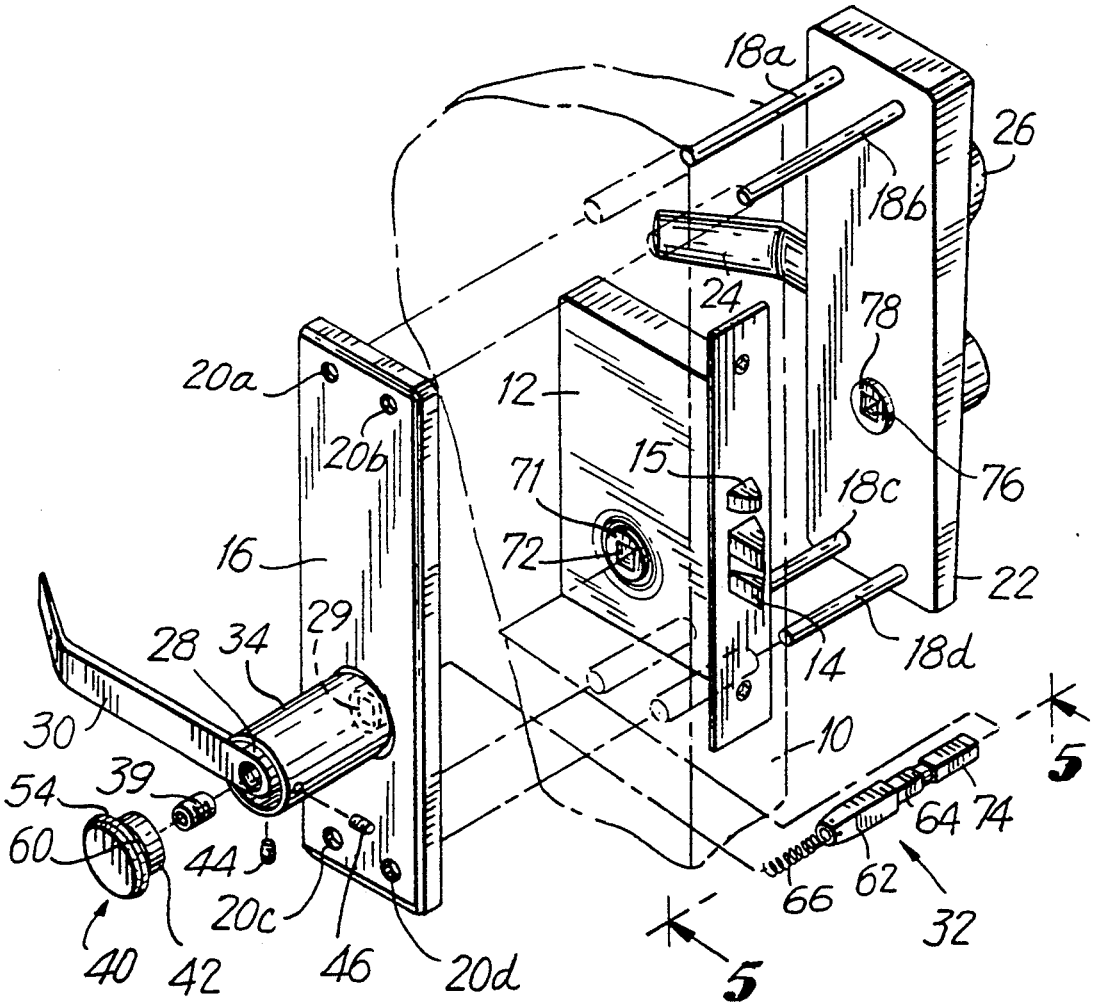
FIG. 1 is an exploded perspective view of the parts of the instant invention.

Referring now to the drawings, a door 10, having a recessed or mortised latch lockset 12 is depicted, having latches 14 and a deadlatch 15 shown in their extended position. A latch lock is shown for purposes of description since the present invention can also be employed with a deadbolt lock, or a combined deadbolt and latch lock. On the inside of the door 10, which is, for example, the entry door to a large urban apartment house, an inside escutcheon plate 16 is secured to the interior surface of the door 10 by means of bolts 18*a*, 18*b*, 18*c*, and 18*d*, which are secured in apertures 20*a*, 20*b*, 20*c* and 20*d* in the inside escutcheon plate. The bolts 18*a–d*, inclusive, emanate from the inner surface of an outside escutcheon plate 22 which is secured to the exterior surface or front of the door 10.

The outside escutcheon plate has an exterior lever handle 24 which can be activated upon the insertion of a key into a lock cylinder 26. While the locking assembly is depicted as being mechanical in nature, the present invention can also be employed with an electromechanical locking system as well.

Extending transversely and outwardly of the inside escutcheon plate 16 is a rotatable post 28 having integrally formed therewith, at its outermost end, an interior lever handle 30 which extends transversely from post 28. While it is preferred to employ a lever handle, the present invention could also employ a knob, or a paddle, or a panic bar to advantage.

The post 28 has a hollow center, i.e., socket 29, and is rectangular or square in cross-sectional configuration and is adapted to accommodate or receive the spring-loaded end of a square or rectangular spindle 32, as will be discussed in greater detail hereinafter.

The rotatable post member 28 is concentrically mounted within a stationary hub member 34, which is an integral transverse extension of the inside escutcheon plate 16. The outer extent or upper edge of the hub 34 is partially cut away to provide a generally arcuate-shaped, partial cut-out segment 36, within the limited confines of which the interior lever handle 30 can rotate in response to its being actuated. Either end of the cut-out segment 36 of hub 34 serves to define stops 38 and 38', which can best be seen by reference to FIG. 3. The stops 38 and 38' limit the extent or degree to which the interior lever handle 30 can rotate, thus preventing damage to the interior parts of the lock by wear and tear.

Figure 4:
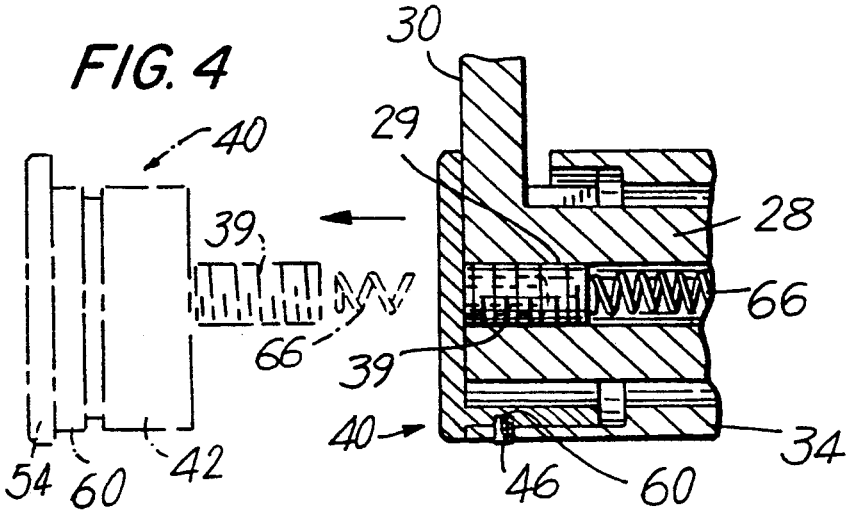
FIG. 4 is a cross-sectional view taken along the line 4—4 of FIG. 2.

The spring-loaded end of spindle 32 is threadably secured, with its spring in a compressed state, as can be seen in FIG. 4, within socket 29 of post 28, by a screw 39, exemplary of which is a hexagonal, or Allen screw.

Seated atop post 28 and the integral inner end of interior lever handle 30 is an end cap 40. The end cap 40 which has a mushroom-like configuration, and which has a downwardly extending circular discontinuous wall element or skirt 42, which defines its outer body, and which when secured in its operative mode extends or lies between the inner wall of hub 34 and the outer surface of post 28. The end cap 40, whose construction will be discussed in greater detail hereinafter, is in overlying relationship to hub 34 and is secured thereto by means of set screws 44 and 46, exemplary of which are hexagonal or Allen screws. While the end cap 40 is secured in place, it does, nonetheless, rotate in unison with the lever handle 30. While hexagonal-type screws are depicted, other appropriate securing means can be employed to good advantage.

Figure 2:
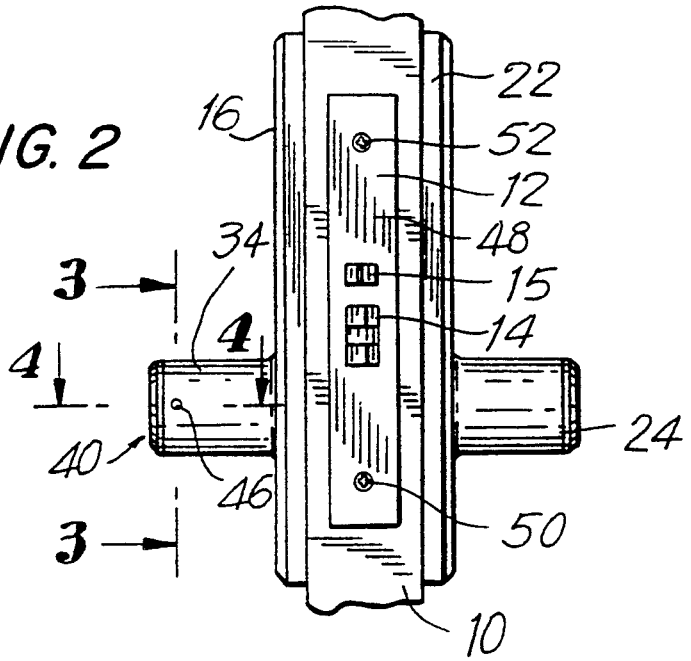
FIG. 2 is a partial end view of the door and the latch lock.

FIG. 2 depicts the lockset 12 affixed to a faceplate 48 by means of screws 50 and 52, exemplary of which are Phillips screws, which is recessed or mortised in door 10. In lieu of the Phillips screws, either Allen or Torx head screws may be employed.

Figure 3:
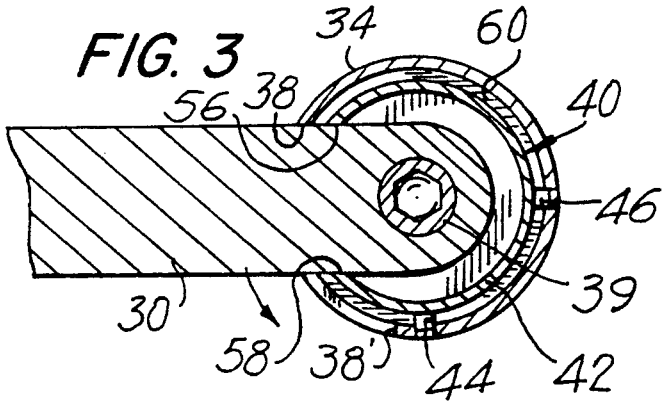
FIG. 3 is a cross-sectional view taken along the line 3—3 of FIG. 2.
Figure 6:
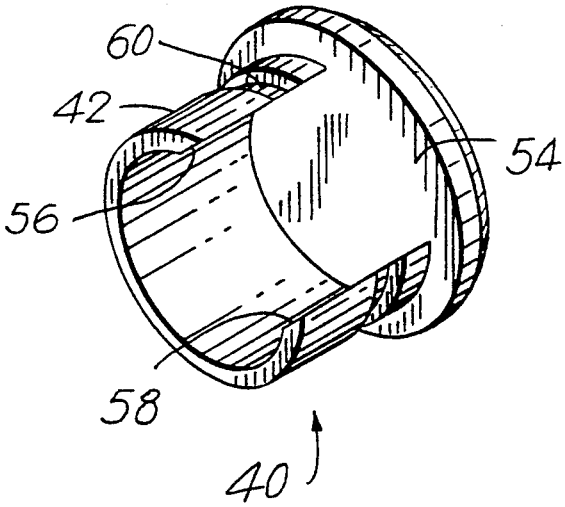
FIG. 6 is a perspective view of the end cap of the present invention.

From FIGS. 3, 4 and 6, we can see the construction of the end cap 40 to better advantage. The end cap 40 consists of a top cap portion 54, downwardly extending, discontinuous circular wall element or skirt 42, having angular abutment surfaces 56 and 58, which are contiguous with opposite sides of the inner lever handle 30, and which rotate therewith in unison with the rotation of the post 28. Wall element or skirt 42 has a circumferential groove or channel 60 cut therein, proximate to, but slightly offset, from the top cap 54.

The functioning of the end cap 40 can best be seen by reference to FIG. 3. When the latch lock 12 is in its operative, undamaged state and is functioning in its intended manner, upon the application of a downward, counterclockwise force or pressure to the interior lever handle 30, end cap 40 and post 28 rotate simultaneously with one another. The presence of skirt 42 in conjunction with stops 38 and 38' prevents the insertion of an implement to vandalize the end cap and, concomitantly, prevents damage to the lock by limiting the movement of the interior lever handle 30. The set screws 44 and 46 hold the end cap 40 in secured alignment within circumferential groove 60.

Figure 5:
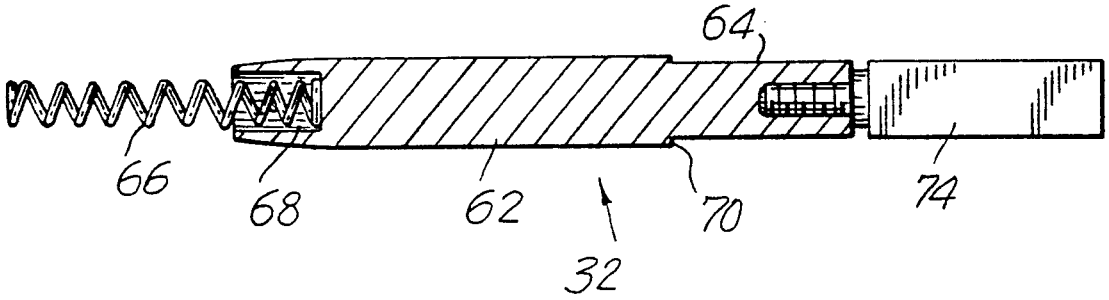
FIG. 5 is a cross-sectional view taken along the line 5—5 of FIG. 1.

As can be seen by reference to FIG. 5, the spindle 32 is depicted as comprised of two ends, namely, a second end 62 and a first end 64, both of which are square in cross-section. Second spindle end 62, which is, for example, 8 mm. On each side, has a spring 66 fixedly mounted in a recess 68 provided in the front of end 62. First spindle end 64 of spindle 32 has a stepped-down area or stop, i.e. shoulder, 70, which is, for example, 7 mm. On each side, which serves as a line of demarcation or transition between the ends 62 and 64 of the spindle 32. Thus, the total area or dimensions of the second end 62 of spindle 32 is greater than the first end 64 of spindle 32. The stop or shoulder 70 serves to limit the extent of the spindle's entry into a bushing 71 which defines a spindle aperture 72 in lock 12, and which bushing 71 is adapted to accommodate the first end 64 of spindle 32.

At the first end 64 of spindle 32, there is provided a threaded, screw-on spindle extension 74. Spindle extension 74 fits into and is seated in rotatable socket 76 formed in a post 78. Thus, under normal operating conditions, i.e., key insertion or electrical activation followed by actuation of the exterior lever handle 24, or by actuation of the interior lever handle 30 from within the apartment house, the spindle 32 is adapted to rotatably displace the bushing 71 and thereby actuate the latch 14.

Turning to FIG. 4 of the present invention, one can best see the functioning of the spring-loaded spindle 32 of the present invention. While it is preferred to employ a spring-loaded spindle, it should be understood that a spindle without a spring can also be employed. Assuming the latch lock 12 has been damaged, by vandalism or otherwise, end cap 40 is first removed by unscrewing set screws 44 and 46. Next, screw 39 is readily removed from socket 29 in post 28. Once screw 39 has been removed, spring 66 will expand to allow removal of the spindle 32 outwardly from the socket 29, thus avoiding the need to remove the inside escutcheon plate 16, or lock cylinder 26, or interior lever handle 30, or outside escutcheon plate 22 to gain access to the damaged lock.

Phillips screws 50 and 52 holding the faceplate 48 to the damaged latch lock 12 are then unscrewed and the entire lock 12 is removed. A replacement lock is inserted in its stead and resecured. Thereafter, the spindle 32 is reinserted and resecured as is the end cap 40.

Thus, by employing the structure of the present invention a damaged latch lock may be readily and easily replaced by building maintenance personnel in a shortened period of time without the need to call upon the services of a professional locksmith.

What is claimed is:

1. A doorlocking assembly comprising:

(a) a lock set mountable within a door;

(b) said lock set including latch means for locking the door;

(c) spindle means engageable with the lock set, said lock set including a bushing defining a spindle aperture for accommodating a first end of the spindle means;

(d) said spindle means being adapted to rotatably displace the bushing for actuating the latch means;

(e) handle means for receiving a second end of the spindle means;

(f) said handle means being independent of said spindle means and defining a socket for withdrawing the spindle means to remove the lock set from within the door without removing the handle means.

2. A door locking assembly as claimed in claim 1, wherein the handle means includes a rotatable post member concentrically mounted within a stationary hub member.

3. A door locking assembly as claimed in claim 2, wherein the socket is formed in the post member.

4. A door locking assembly as claimed in claim 2, further including an end cap securable to the hub member in overlying relationship with respect to the socket.

5. A door locking assembly as claimed in claim 4, wherein the end cap includes a skirt portion, said skirt portion being rotatable and extending between the post member and the hub member when the end cap is seated in an operative mode.

6. A door locking assembly as claimed in claim 5, wherein the upper edge of said hub member is partially cut away to define a cut-out segment therein, either end of said cut-out segment defining a stop which serves to limit the degree of rotation of the handle means.

7. A door locking assembly as claimed in claim 6, wherein the end cap is secured to the hub member.

8. A door locking assembly as claimed in claim 7, further including an interior lever handle extending transversely from the post member.

9. A door locking assembly as claimed in claim 8, wherein the skirt portion is formed by a discontinuous circular wall member having a circumferential groove therein and having angular abutment surfaces, said abutment surfaces being contiguous with opposite sides of the lever handle, and said end cap being simultaneously rotatable with the post member.

10. A door locking assembly as claimed in claim 9, wherein the spring loaded spindle means is maintained in the socket with the spring in a compression state, by a screw member threadably secured within the socket.

11. A doorlocking assembly comprising:

(a) a lock set mountable within a door;

(b) said lock set including latch means for locking the door;

(c) spindle means engageable with the lock set, said lock set including a bushing defining a spindle aperture foe accommodating a first end of the spindle means;

(d) said spindle means being adapted to rotatably displace the bushing for actuating the latch means;

(e) handle means for receiving a second end of the spindle means;

(f) said handle means defining a socket for withdrawing the spindle means to remove the lock set from within the door;

(g) said spindle means being spring-loaded within the socket.

12. A door locking assembly as claimed in claim 11, wherein the handle means including a rotatable post member concentrically mounted within a stationary hub member.

13. A door locking assembly as claimed in claim 12, wherein the socket is formed in the post member.

14. A door locking assembly as claimed in claim 12, further including an end cap securable to the hub member in overlying relationship with respect to the socket.

15. A door locking assembly as claimed in claim 14, wherein the end cap includes a skirt portion, said skirt portion being rotatable and extending between the post member and the hub member when the end cap is seated in an operative mode.

16. A door locking assembly as claimed in claim 15, wherein the upper edge of said hub member is partially cut away to define a cut-out segment therein, either end of said cut-out segment defining a stop which serves to limit the degree of rotation of the handle means.

17. A door locking assembly as claimed in claim 16, wherein the end cap is secured to the hub member.

18. A door locking assembly as claimed in claim 17, further including an interior lever handle extending transversely from the post member.

19. A door locking assembly as claimed in claim 18, wherein the skirt portion is formed by a discontinuous circular wall member having a circumferential groove therein and having angular abutment surfaces, said abutment surfaces being contiguous with opposite sides of the lever handle, and said end cap being simultaneously rotatable with the post member.

20. A door locking assembly as claimed in claim 19, wherein the spring loaded spindle means is maintained in the socket with the spring in a compression state, by a screw member threadably secured within the socket.

* * * * *